United States Patent [19]

Manning

[11] Patent Number: 4,846,525

[45] Date of Patent: Jul. 11, 1989

[54] SPRAY SYSTEM FOR SUN TANNING

[76] Inventor: Ted A. Manning, P.O. Box 4773 Snake Tree Plaza, Palm Springs, Calif. 92264

[21] Appl. No.: 150,911

[22] Filed: Jan. 11, 1988

Related U.S. Application Data

[63] Continuation of Ser. No. 752,026, Jul. 5, 1985, abandoned.

[51] Int. Cl.[4] ..... A47C 7/72

[52] U.S. Cl. ..... 297/180; 222/175; 239/289; 239/327; 297/217

[58] Field of Search ..... 297/180, 188, 192, 217; 5/417–420; 222/175, 183, 207; 239/289, 327, 328, 330, 331

[56] References Cited

U.S. PATENT DOCUMENTS

| | | | |
|---|---|---|---|
| 218,366 | 8/1879 | Campion | 239/330 X |
| 222,831 | 12/1879 | Marsh | 222/175 X |
| 580,284 | 4/1897 | Krieg, Sr. | 297/180 X |
| 1,932,615 | 10/1933 | Bumpass | 239/327 |
| 2,572,264 | 10/1951 | Horton | 239/331 X |
| 3,625,434 | 12/1971 | Kitover | 297/180 X |
| 4,258,706 | 3/1981 | Shank | 297/180 X |
| 4,548,357 | 10/1985 | Schmidt | 297/180 X |

FOREIGN PATENT DOCUMENTS

| | | | |
|---|---|---|---|
| 750665 | 6/1956 | United Kingdom | 239/330 |

*Primary Examiner*—Peter R. Brown
*Attorney, Agent, or Firm*—G. Donald Weber, Jr.

[57] ABSTRACT

A spray system for the periodic application of sun tanning solution for the cooling and comfort of the user. In one embodiment, the system may be utilized in conjunction with a conventional lounge chair. The lounge chair has one or more longitudinal rails along the sides thereof, and a tanning-solution-containing bladder or reservoir may be affixed to the chair. A solution tube extends into the bladder and a pump conveys solution from the bladder to a plurality of spray nozzles. In the embodiment noted, the nozzles may be affixed to one of the rails of the chair. When desired, the user operates the pump to discharge a mist of water and tanning aid solution which cools the user.

14 Claims, 2 Drawing Sheets

SPRAY SYSTEM FOR SUN TANNING

This is a continuation of application Ser. No. 752,026, filed July 5, 1985, now abandoned.

BACKGROUND OF THE INVENTION

1. Field of the Invention

This invention is directed, generally, to leisure products, including furniture. The invention relates, more specifically, to outdoor or patio leisure products and furniture commonly used for lying in the sun to obtain a sun tan.

2. Background

Many people are desirous of obtaining a suntan as an aspect of overall appearance of health or beauty. These people usually "sit-out" in the sun on a lounge chair, a beach towel or the like.

Most chairs or towels used for sun tanning are placed adjacent a swimming pool or spa or on the beach. Thus, if the user becomes uncomfortably warm lying in the sun, he or she can enter the pool or spa to cool off. A disadvantage of such approach, however, is that sun tanning creams or lotions are removed by the pool or spa water. This not only requires the re-application of such creams or oils, but also tends to contaminate the water, especially the pool or spa. Such creams or oils tend to be immiscible substances which in pool water tend not only to swell the waterline containment surfaces, such as tile, but also clog pool filters and create other undesirable effects.

One solution to this problem is shown in U.S. Pat. No. 3,625,434 E. R. Kitover where a lounge chair is affixed with a plurality of nozzles which are attached to a garden hose. This approach has several disadvantages. If such chair is used at a hotel or spa, it can be readily envisioned that a number of garden hoses will create a safety hazard. Furthermore, in many tanning operations, for example at the beach a garden hose is not convenient. Still further, a garden hose contains tap water which does not have any oils or emollients and may, in fact, comprise "hard" water. Yet further, a garden hose is connected to a source of relatively high pressure water and any tubing and nozzles must be designed with sufficient strength to withstand this relatively high water pressure.

SUMMARY OF THE INVENTION

It is an object of the present invention to provide a spraying system for the periodic application of sun tanning solutions, which system is self-contained and portable but need not be connected to a garden hose. The system may be attached to a conventional lounge chair or beach chair The present invention is for a spraying system for the periodic, controlled, application of sun tanning solutions for the cooling and comfort of the user. The system includes a bladder or reservoir for storing the solution, water, or the like. In the embodiment using a lounge chair of the type having a longitudinal rail along each side, the tanning-solution-containing bladder is mounted thereto. A solution tube extends into the bladder for conveying fluid from within the bladder and is connected to the inlet of a pump. The pump has an outlet to which a solution tube is connected and this, in turn, is connected to a manifold, A plurality of nozzles are affixed to the manifold through tubes. In one embodiment, the nozzles are affixed to at least one longitudinal rail of a lounge chair. Preferably, the pump is a hand-operated pump which limits the potential pressure which may be generated. A preferred type of hand-operated pump is a rubber bulb pump. The bulb can be any design including a two-valve bulb. A preferable nozzle has a strap or other positioning device molded directly thereto so that it may be firmly affixed and aimed in the proper direction, for example upon the rail of the lounge chair.

DESCRIPTION OF THE PREFERRED EMBODIMENTS

Figure 1:
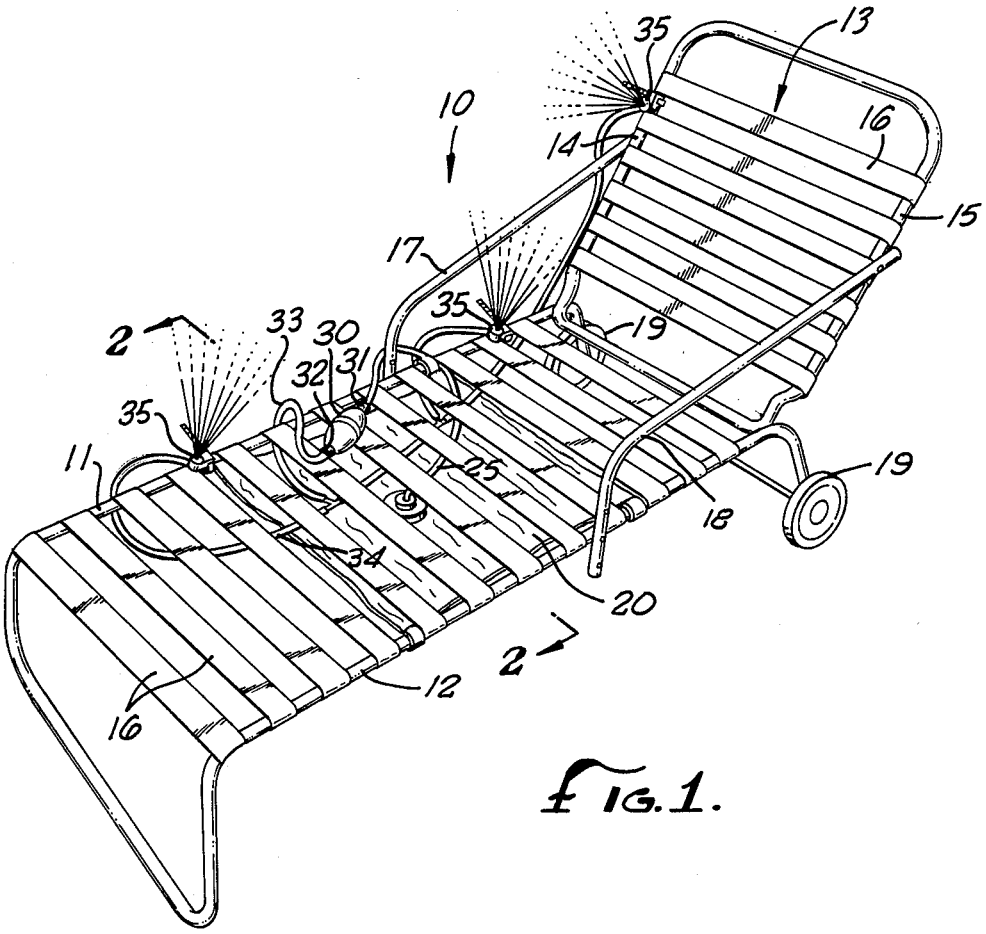
FIG. 1 is a perspective view of the spray system of the present invention. mounted to a conventional lounge chair.
Figure 2:
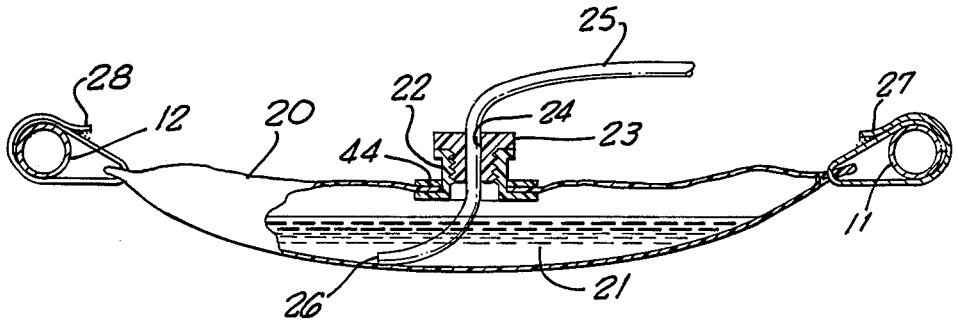
FIG. 2 is an enlarged cross-sectional view of the bladder as attached to the lounge chair of FIG. 1.

A spraying system for the periodic application of tanning solutions and attached to a lounge chair is shown in FIG. 1 and indicated generally by reference character 10. The lounge chair has a right side rail 11, a left side rail 12 and the back 13 has a right side rail 14 and a left side rail 15. A plurality of straps support the user in a conventional manner. Optional arms 17 and 18 and wheel s19 are also conventional. In this embodiment, there is attached to the lounge chair a bladder 20 which may be filled with a solution of a sun tanning oil, emollients or other skin creams which are, preferably, of the water soluble type to retain low viscosity and also to provide a homogeneous solution. The solution is shown in FIG. 2 and indicated by reference character 21. The term, "tanning solution," as used, herein, is intended in its very broadest sense to include not only the above-referenced solutions but, also, simply water, alone, which can function, of course, as a cooling and tanning aid. Bladder 20 has a threaded opening member 22 sealed over an opening in bladder 20. A sealing ring 44 holds member 22 over the opening in the bladder. A cap 23 is screwed into the threaded opening in member 22 and has a hole 24 therethrough which supports a tube 25 which has an entrance 26 at the bottom of the bladder and below the level of solution 21. In this embodiment, bladder 20 is strapped to rails 11 and 12 by straps 27 and 28 which may be tied or affixed by hook and eye tape of the type commonly sold under the trademark, "Velcro ®." Bladder 20 should, of course, be fabricated from a flexible material having excellent resistance to ultra violet radiation.

Tube 25 leads to a pump 30 which has an inlet 31 and an outlet 32. Pump 30 conveys the tanning solution through tube 25 into an outlet tube 33 which is connected to a manifold 34 which conveys solution either directly or through a separate tube to a plurality of nozzles 35.

It is important that the nozzles of the present invention be positionable, for example affixable to the rail of a chair, in a very secure manner so that they can be aimed in a desired direction. Preferably, the nozzles should project a spray upward and inward and should result in their soft descent of the spray on the user-occupied area. Although the drawings show the nozzles positioned only along one side of the lounge chair, it is preferred in sheltered areas to place nozzles along both sides of the user-occupied area in a manner identical to those nozzles attached as shown in the drawings. Thus, the present invention, is not limited to a lounge chair or a spray system with nozzles along only one side.

Figure 3:
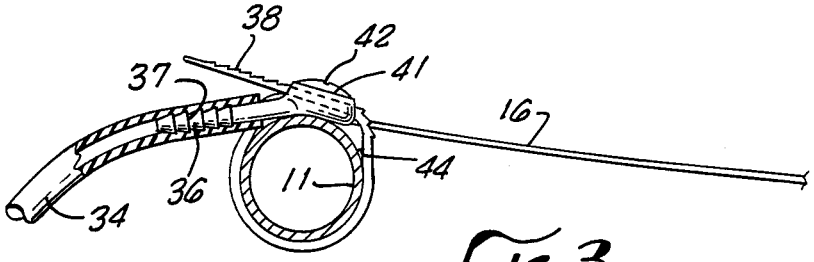
FIG. 3 is an enlarged cross-sectional view of a nozzle assembly as attached to the lounge chair of FIG. 1.
Figure 5:
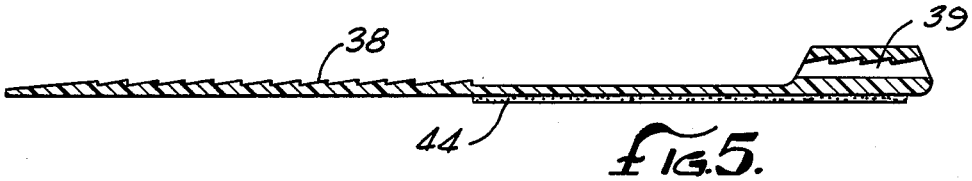
FIG. 5 is a cross-sectional view of the nozzle and strap taken along line 5—5 of FIG. 4.
Figure 4:
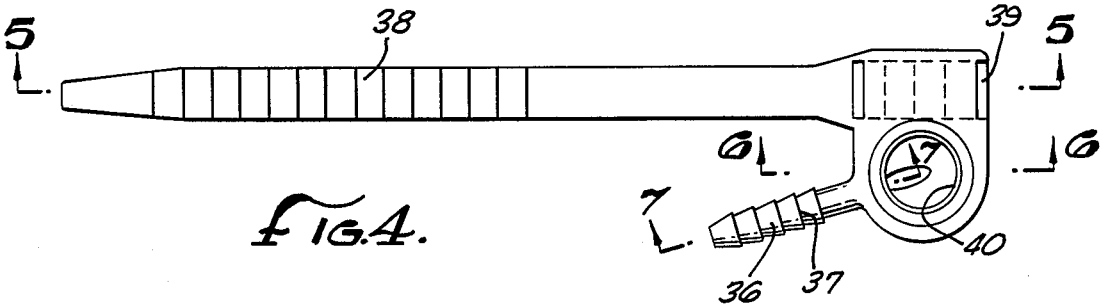
FIG. 4 is a plan view of the nozzle and strap assembly of the instant invention.
Figure 6:
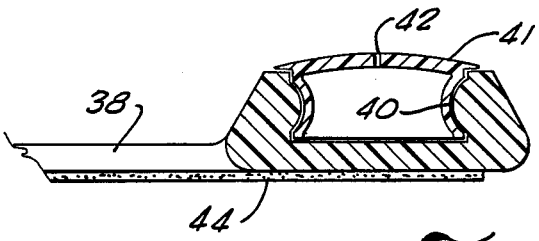
FIG. 6 is an enlarged cross-sectional view of a portion of the nozzle and strap taken along line 6—6 of FIG. 4.
Figure 7:
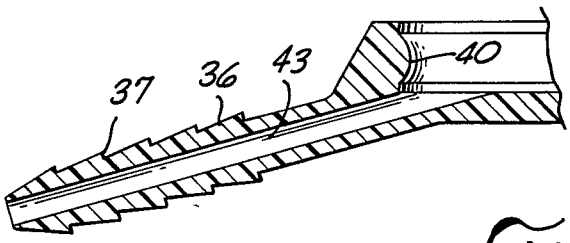
FIG. 7 is an enlarged cross-sectional view of the nozzle taken along line 7—7 of FIG. 4.

A particularly effective nozzle assembly has the strap and entry nipple of the nozzle molded from a single piece of plastic. In this way, the nozzle can be securely positioned in a desired orientation about a rail or similar support device. As shown in FIG. 3, entry nipple 36 has a plurality of teeth 37 which help to hold tube 34 onto the nozzle assembly. A toothed strap 38 is held in a toothed entry way shown best in cross-sectional view in FIG. 5 and indicated by reference character 39. A layer of delayed tack adhesive 44 may be placed along a part of the underside of the strap 38 to help hold the assembly against turning on the rail or similar support device. A nozzle-holding port 40 holds a nozzle 41 which has an orifice 42. Nozzle 41 is open at the bottom and solution from pump 30 passes through fluid passageway 43 into the bottom of nozzle 41 and out through orifice 42 in a fine mist.

It can readily be seen that the spray system, the lounge chair assembly and the tubing thereof need not withstand city water pressure but merely be strong enough to withstand the pressure created by the hand-operated pump 30. It is also possible that solution 21 may be customized for the user. For instance, a relatively high degree of sun screen might be added for someone who desired this, whereas a lesser amount might be used by another. Oils and perfumes to suit the user's needs may also be customized as desired.

While the bladder is shown affixed to lounge chair 10, it may alternatively be placed on the ground adjacent the chair or the user-occupied area. It is only necessary that the hand-operated pump 30 be readily accessible and be capable of being placed in a comfortable position for the user to operate. The nature of the pump 30 can be in the form of a squeeze-bulb, a diaphragm pump, a peristaltic pump, or the like which is hand-operated and/or controlled by the user of the system While the nozzle and strap assembly have been shown in the drawings as a lockable type, other designs of clamps may alternatively be used. It is important, however, that the nozzle be capable of being securely affixed in a desired location.

Materials of construction should be used which have excellent ultraviolet resistance. Black polyethylene has been found to be satisfactory both for the nozzle and tubing assembly.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A spray system for the periodic application of sun tanning solutions for the cooling and comfort of the user, said system comprising:

a bladder for containing a fluid tanning solution;

a solution tube extending into said bladder for conveying fluid from within said bladder;

pump means having an inlet and an outlet, said inlet being connected to said solution tube outside of said bladder for pressurizing said solution at the outlet of said pump means;

said pump means comprises a flexible bulb means which is adapted to be operated by manual squeezing;

said flexible bulb means having an inlet valve and an outlet valve;

a solution manifold connected to the outlet of said pump means; and a plurality of nozzle means affixed to said solution manifold by a plurality of solution tubes, each of said nozzle means including strap means to assist in positioning each of said nozzle means.

2. The system of claim 1 wherein, each of said nozzle means has said strap means integrally molded thereto.

3. The spray system recited in claim 1 including, lounge chair means including at least one longitudinal rail at a side thereof and adapted to support said spray system.

4. The system of claim 3 wherein, said bladder is suspended from said longitudinal rail of said chair.

5. The spray system recited in claim 4 wherein, said plurality of nozzle means are mounted on said at least one longitudinal rail of said lounge chair.

6. A kit for permitting a user to selectively spray a tanning solution onto the user of the kit, said kit comprising:

bladder means for holding a liquid solution, said bladder means having a liquid solution outlet tube leading therefrom;

pump means having an inlet and an outlet; the inlet of said pump means being affixable to the liquid outlet tube of said bladder means;

said pump means comprises a flexible bulb means which is adapted to be operated by manual squeezing;

said flexible bulb means having an inlet valve and an outlet valve;

manifold means affixable to the outlet of said pump means; and a plurality of assemblies each including tube and nozzle portions said nozzle portions having means for maintaining said nozzle portions in a preferred position to control the direction of spray therefrom;

said tubes connected between said mainfold means and said nozzle portions.

7. The kit of claim 6 wherein said nozzle portions have a strap integrally molded thereto.

8. The kit of claim 6 wherein said nozzle assembly has strap means having a delayed tack adhesive located on a portion thereof.

9. In combination bladder means resistant to ultraviolet radiation for storing a fluid therein;

spray nozzle means including an inlet opening and an outlet orifice;

support means for supporting said spray nozzle means;

said support means includes a strap means adapted for mounting said spray nozzle means;

tubular connecting means connected to said support means for selectively transferring liquid from said bladder means to the inlet opening of said spray nozzle means via said support means.

an opening formed in said bladder means;

cap means adapted to provide a closure for said opening in said bladder means;

said cap means including a hole therethrough for receiving said tubular connecting means in order to communicate with the interior of said bladder means; and pressure means connected to said bladder means via said tubular connecting means for supplying pressure to said fluid within said bladder means thereby to selectively transfer said fluid from said bladder means through said tubular connecting means whereby said fluid exits said outlet orifice of said spray nozzle means in a fine mist.

10. The combination recited in claim 9 wherein, said pressure means is connected between said bladder means and said nozzle means.

11. The combination recited in claim 9 wherein, said spray nozzle means and said strap means are integrally formed.

12. The combination recited in claim 9 wherein, said support means includes an entry port at said input which has a plurality of teeth thereon, said entry port is joined to and retained at said connecting means by said teeth at said input.

13. The combination recited in claim 9 wherein, said spray nozzle means and said support means are two separable components.

14. The combination recited in claim 9 wherein, said outlet orifice permits the entry of air therethrough into said spray nozzle means in the absence of a fluid exiting therethrough.

* * * * *